US011994330B2

(12) United States Patent
Lee et al.

(10) Patent No.: US 11,994,330 B2
(45) Date of Patent: May 28, 2024

(54) REFRIGERATOR

(71) Applicant: LG ELECTRONICS INC., Seoul (KR)

(72) Inventors: Donghoon Lee, Seoul (KR); Donghoon Lee, Seoul (KR); Wookyong Lee, Seoul (KR); Seungseob Yeom, Seoul (KR); Yongjun Bae, Seoul (KR); Sunggyun Son, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/282,099

(22) PCT Filed: Oct. 1, 2019

(86) PCT No.: PCT/KR2019/012875
§ 371 (c)(1),
(2) Date: Apr. 1, 2021

(87) PCT Pub. No.: WO2020/071762
PCT Pub. Date: Apr. 9, 2020

(65) Prior Publication Data

US 2021/0372684 A1 Dec. 2, 2021

(30) Foreign Application Priority Data

Oct. 2, 2018 (KR) ..... 10-2018-0117785
Oct. 2, 2018 (KR) ..... 10-2018-0117819
(Continued)

(51) Int. Cl.
*F25C 1/24* (2018.01)
*F25C 5/08* (2006.01)

(52) U.S. Cl.
CPC ..... *F25C 1/24* (2013.01); *F25C 5/08* (2013.01); *F25C 2400/10* (2013.01); *F25C 2400/14* (2013.01); *F25C 2600/04* (2013.01)

(58) Field of Classification Search
CPC ..... F25C 1/24; F25C 5/08; F25C 2400/10; F25C 2400/14; F25C 2600/04
See application file for complete search history.

(56) References Cited

U.S. PATENT DOCUMENTS 4,910,974 A * 3/1990 Hara ..... F25C 1/045 62/352
9,335,081 B2 * 5/2016 Son ..... F25C 1/04
(Continued)

FOREIGN PATENT DOCUMENTS

CN 106352638 1/2017
EP 3059526 8/2016
(Continued)

OTHER PUBLICATIONS

International Search Report (with English Translation) dated Jan. 30, 2020 issued in Application No. PCT/KR2019/012875.
(Continued)

*Primary Examiner* — Elizabeth J Martin
*Assistant Examiner* — Samba Gaye
(74) *Attorney, Agent, or Firm* — KED & ASSOCIATES, LLP

(57) ABSTRACT

The refrigerator includes: a first tray forming a part of ice-making cells which are where water changes phase into ice due to cold air; a second tray forming the other part of the ice-making cells; and a temperature sensor for sensing the temperature of the water or ice in the ice-making cells, wherein the temperature sensor comes into contact with the first tray and/or the second tray.

19 Claims, 13 Drawing Sheets

(30) Foreign Application Priority Data

| | | |
|---|---|---|
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081710 |

(56) References Cited

U.S. PATENT DOCUMENTS

| | | | | |
|---|---|---|---|---|
| 11,079,153 | B2 * | 8/2021 | Song | F25C 1/04 |
| 2006/0090485 | A1 | 5/2006 | Lee et al. | |
| 2010/0122543 | A1 * | 5/2010 | Lee | F25C 5/08 62/340 |
| 2012/0186292 | A1 | 7/2012 | Kim | |
| 2013/0014536 | A1 | 1/2013 | Son et al. | |
| 2014/0165598 | A1 * | 6/2014 | Boarman | F25C 1/22 62/347 |
| 2014/0182325 | A1 | 7/2014 | Lee et al. | |
| 2017/0299244 | A1 * | 10/2017 | Alshourbagy | F25C 5/06 |
| 2018/0231294 | A1 | 8/2018 | Song et al. | |

FOREIGN PATENT DOCUMENTS

| | | |
|---|---|---|
| JP | H05-203299 | 8/1993 |
| JP | H05-203302 | 8/1993 |
| JP | H06-70543 | 9/1994 |
| JP | H09-269172 | 10/1997 |
| JP | 2003-114072 | 4/2003 |
| JP | 2005-326035 | 11/2005 |
| JP | 4572833 | 11/2010 |
| JP | 2011-064371 | 3/2011 |
| JP | 2011-064373 | 3/2011 |
| JP | 2011-237077 | 11/2011 |
| KR | 10-2005-0069319 | 7/2005 |
| KR | 10-2005-0096336 | 10/2005 |
| KR | 10-2009-0079377 | 7/2009 |
| KR | 10-2012-0003233 | 1/2012 |
| KR | 10-2013-0009332 | 1/2013 |
| KR | 10-2013-0009521 | 1/2013 |
| KR | 10-2014-0088321 | 7/2014 |
| KR | 10-1502120 | 3/2015 |
| KR | 10-1643635 | 7/2016 |
| KR | 10-1850918 | 5/2018 |
| KR | 10-2018-0093666 | 8/2018 |
| KR | 10-2018-0100752 | 9/2018 |

OTHER PUBLICATIONS

Chinese Office Action dated May 19, 2022 issued in Application No. 201980063695.9.

European Search Report dated Jun. 28, 2022 issued in Application No. 19870028.8.

Korean Office Action dated May 1, 2023 issued in Application No. 10-2018-0117785.

Korean Office Action dated May 8, 2023 issued in Application No. 10-2018-0117819.

Korean Office Action dated May 14, 2023 issued in Application No. 10-2018-0117821.

Korean Office Action dated May 15, 2023 issued in Application No. 10-2018-0117822.

Korean Office Action dated Apr. 26, 2023 issued in Application No. 10-2023-0021738.

Korean Office Action dated Jul. 4, 2023 issued in Application No. 10-2018-0142117.

Korean Office Action dated Nov. 7, 2023 issued in Application No. 10-2018-0117821.

Korean Notice of Allowance dated Jan. 10, 2024 issued in Application No. 10-2018-0142117.

Korean Office Action dated Mar. 12, 2024, issued in Application No. 10-2018-0117822.

* cited by examiner

REFRIGERATOR

CROSS-REFERENCE TO RELATED PATENT APPLICATIONS

This application is a U.S. National Stage Application under 35 U.S.C. § 371 of PCT Application No. PCT/KR2019/012875, filed Oct. 1, 2019, which claims priority to Korean Patent Application Nos. 10-2018-0117785, filed Oct. 2, 2018; 10-2018-0117819, filed Oct. 2, 2018; 10-2018-0117821, filed Oct. 2, 2018; 10-2018-0117822, filed Oct. 2, 2018; 10-2018-0142117, filed Nov. 16, 2018; and 10-2019-0081710, filed Jul. 6, 2019, whose entire disclosures are hereby incorporated by reference.

TECHNICAL FIELD

The present disclosure relates to a refrigerator.

BACKGROUND ART

In general, refrigerators are home appliances for storing food at a low temperature in a storage space that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray.

The ice maker separates the made ice from the ice tray in a heating manner or twisting manner.

The ice maker through which water is automatically supplied, and the ice automatically separated may be, for example, opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Patent Registration No. 10-1850918 that is a prior art document.

The ice maker disclosed in the prior art document includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the case of the prior art document, the ice maker further includes a heat separation heater for heating the upper cell to separate ice. However, there is a problem in that there is no means for detecting a change in temperature due to cold air for cooling and heat transferred from the ice separation heater.

DISCLOSURE

Technical Problem

Embodiments provide a refrigerator including a temperature sensor detecting a temperature of a tray, which is a means for detecting a time point at which approbate ice making is completed in an operation process of an ice maker.

Embodiments also provide a refrigerator that does not interfere with an electric wire connected to the temperature sensor.

Embodiments also provide a refrigerator in which the temperature sensor is disposed at an optimal position for measuring a temperature inside a tray.

Embodiments also provide a refrigerator in which reliability at a time point, at which ice making is completed, is improved.

Technical Solution

A refrigerator according to one aspect includes: a first tray configured to define one portion of an ice making cell that is a space in which water is phase-changed into ice by cold air; a second tray configured to define the other portion of the ice making cell; a water supply part configured to supply water to the ice making cell; and a temperature sensor configured to detect a temperature of the water or the ice of the ice making cell, wherein the temperature sensor is in contact with at least one of the first tray or the second tray.

In an ice making process, the second tray may be in contact with the first tray, and in the ice separation process, the second tray may be spaced apart from the first tray. The second tray may be connected to a driver.

The controller may control a cold air supply part to supply the cold air to the ice making cell after the second tray moves to an ice making position after the water supply to the ice making cell is completed. The controller may control the second tray to move to an ice separation position in a forward direction so as to take ice out of the ice making cell after the ice is completely generated in the ice making cell. The controller may control the second tray to move from an ice separation position to a water supply position in a reverse direction after the ice separation is completed so as to supply the water.

At least one of the first tray or the second tray may include a sensor accommodation part in which the temperature sensor is accommodated.

The temperature sensor may be in contact with the fixed tray of the first tray and the second tray.

A heater may be disposed at a position adjacent to at least one of the first tray or the second tray. The heater may include a transparent ice heater that is turned on in at least partial section while the cold air supply part supplies the cold air so that bubbles dissolved in the water within the ice making cell moves from a portion, at which the ice is generated, toward the water that is in a liquid state to generate transparent ice.

The temperature sensor may be in contact with the tray, which is disposed farthest from the transparent ice heater, of the first tray and the second tray.

The temperature sensor may be in contact with the fixed tray, which have a high temperature change in the ice making process, of the first tray and the second tray.

The ice making cell may be provided in plurality, and at least a portion of the temperature sensor may be disposed between two ice making cells adjacent to each other.

The ice making cell may be provided in plurality, and the temperature sensor may be disposed so that a distance between a cold air hole and the temperature sensor is less than that between a first ice making cell of the plurality of ice making cells, which is disposed farthest from the cold air hole for supplying the cold air by the cold air supply part, and the cold air hole.

The temperature sensor may be disposed to be in contact with the first ice making cell.

The plurality of ice making cells may include a second ice making cell disposed adjacent to the first ice making cell, and at least a portion of the temperature sensor may be disposed between the first ice making cell and the second ice making cell.

The plurality of ice making cells may include a third ice making cell disposed at an opposite side of the first ice making cell based on the second ice making cell, and a distance between a center of the first ice making cell and a center of the second ice making cell may be greater than that between the second ice making cell and a center of the third ice making cell.

The heater may include an ice separation heater configured to supply heat to at least one of the first tray or the second tray in the ice separation process.

The temperature sensor may be disposed to be spaced apart from the ice separation heater, and a distance from the temperature sensor to a contact surface between the first tray and the second tray may be less than that from the ice separation heater to the contact surface between the first tray and the second tray.

Advantageous Effects

According to the proposed invention, the temperature sensor that detects the temperature of the ray, which is the means for detecting the time point at which the approbate ice making is completed in the operation process of the ice maker to improve the improve the reliability at the time point at which the ice making is completed.

In addition, the temperature sensor may be disposed at the optimal position for measuring a temperature the ice inside the tray without interfering with the electric wire connected to the temperature sensor to prevent the temperature sensor from being broken down.

MODE FOR INVENTION

Figure 1B:
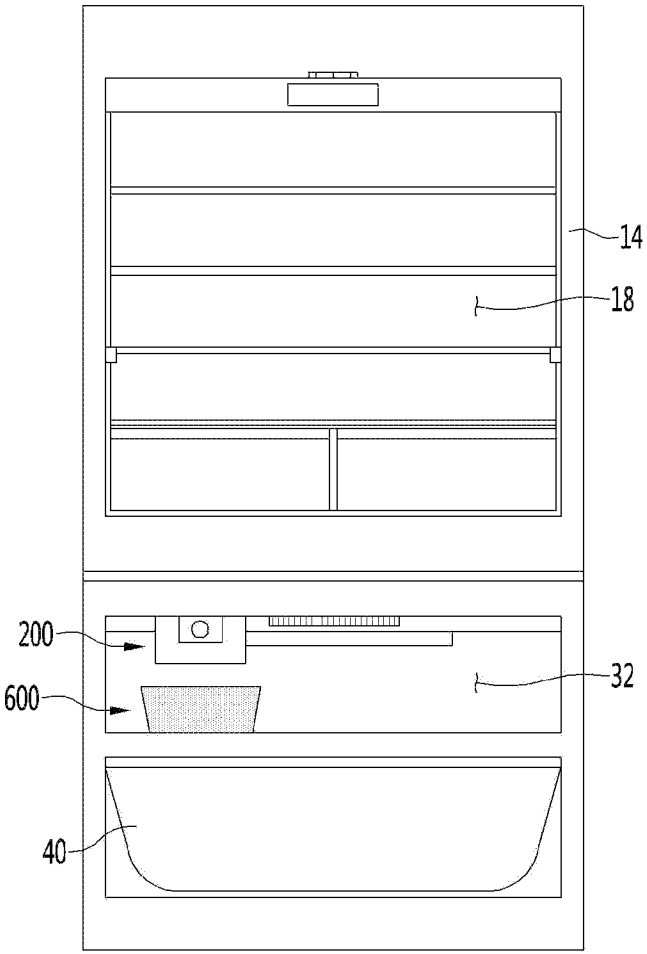
FIG. 1 is a front view of a refrigerator according to an embodiment of the present invention.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component.

It should be understood that when one component is "connected", "coupled" or "joined" to another component, the former may be directly connected or jointed to the latter or may be "connected", coupled" or "joined" to the latter with a third component interposed therebetween.

Figure 1A:
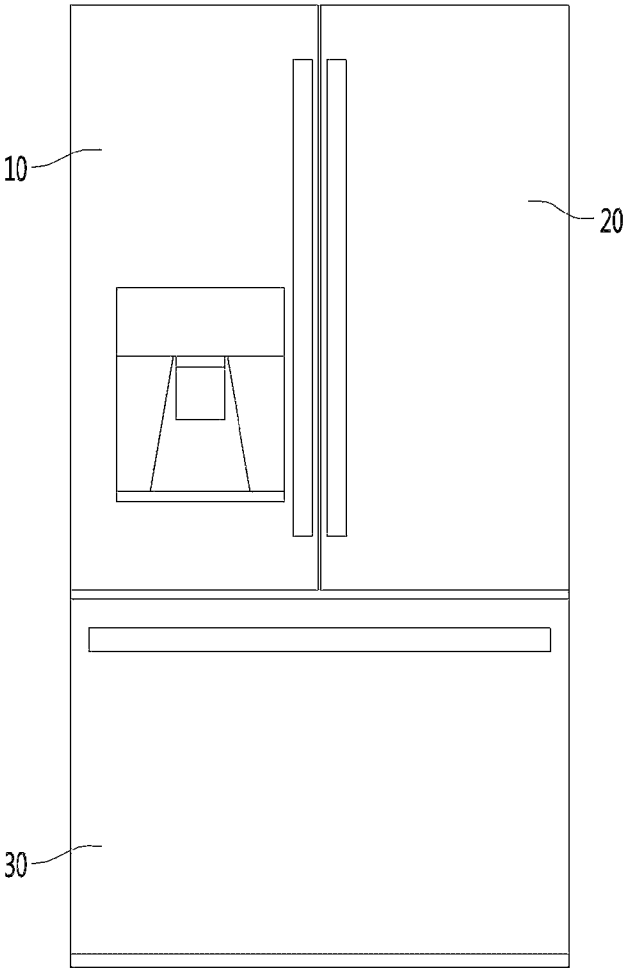

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 14 is disposed at an upper side, and the freezing compartment 32 is disposed at a lower side. Each of the storage chamber may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner.

The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 drops to be stored may be disposed below the ice maker 200. A user may take out the ice bin 600 from the freezing compartment 32 to use the ice stored in the ice bin 600.

The ice bin 600 may be mounted on an upper side of a horizontal wall that partitions an upper space and a lower space of the freezing compartment 32 from each other.

Although not shown, the cabinet 14 is provided with a duct supplying cold air to the ice maker 200. The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct.

Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

Figure 2:
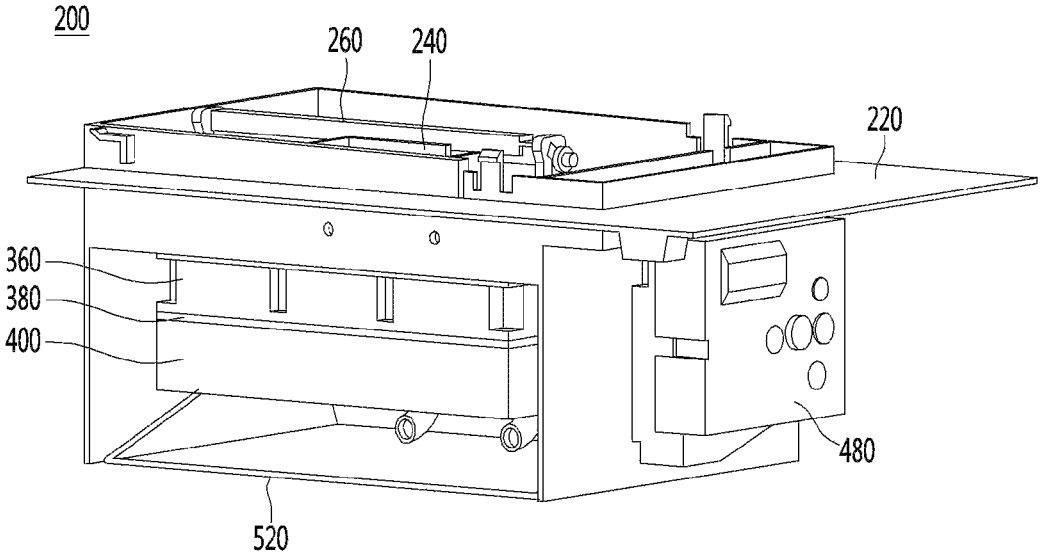
FIG. 2 is a perspective view of an ice maker according to an embodiment of the present invention.
Figure 3:
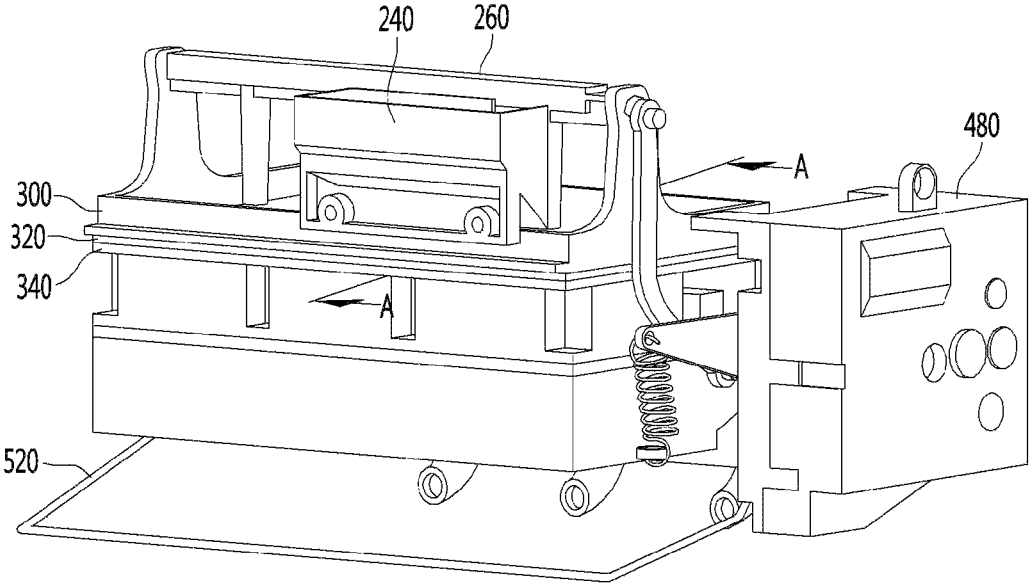
FIG. 3 is a perspective view illustrating a state in which a bracket is removed from the ice maker of FIG. 2.
Figure 4:
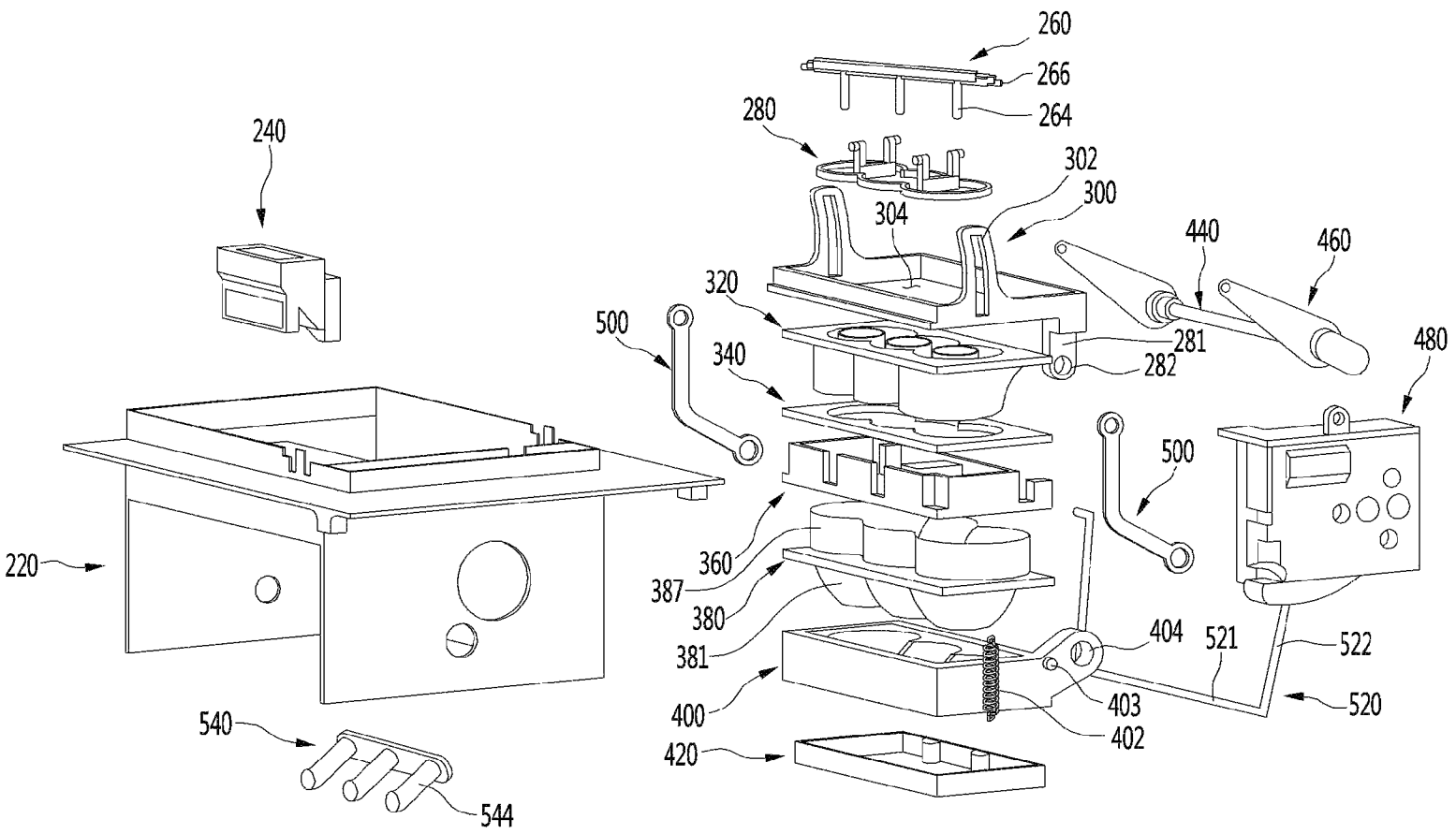
FIG. 4 is an exploded perspective view of the ice maker according to an embodiment of the present invention.

FIG. 2 is a perspective view of the ice maker according to an embodiment, FIG. 3 is a perspective view illustrating a state in which the bracket is removed from the ice maker of FIG. 2, and FIG. 4 is an exploded perspective view of the ice maker according to an embodiment.

Figure 5:
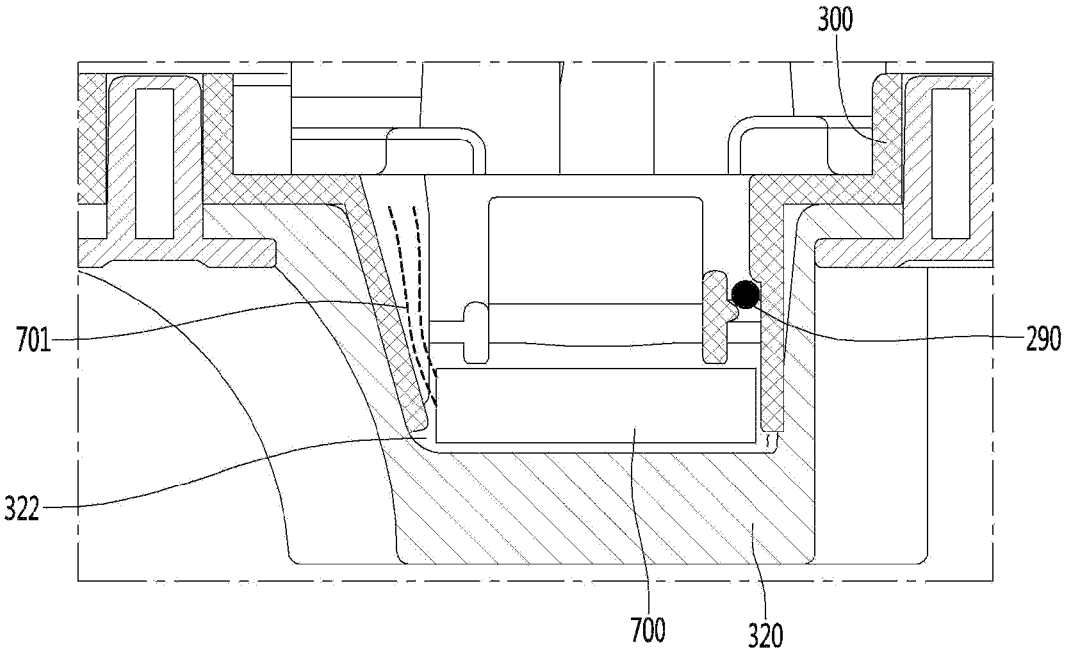
FIG. 5 is a cross-sectional view taken along line A-A of FIG. 3 so as to show a second temperature sensor installed in the ice maker according to an embodiment of the present invention.
Figure 6:
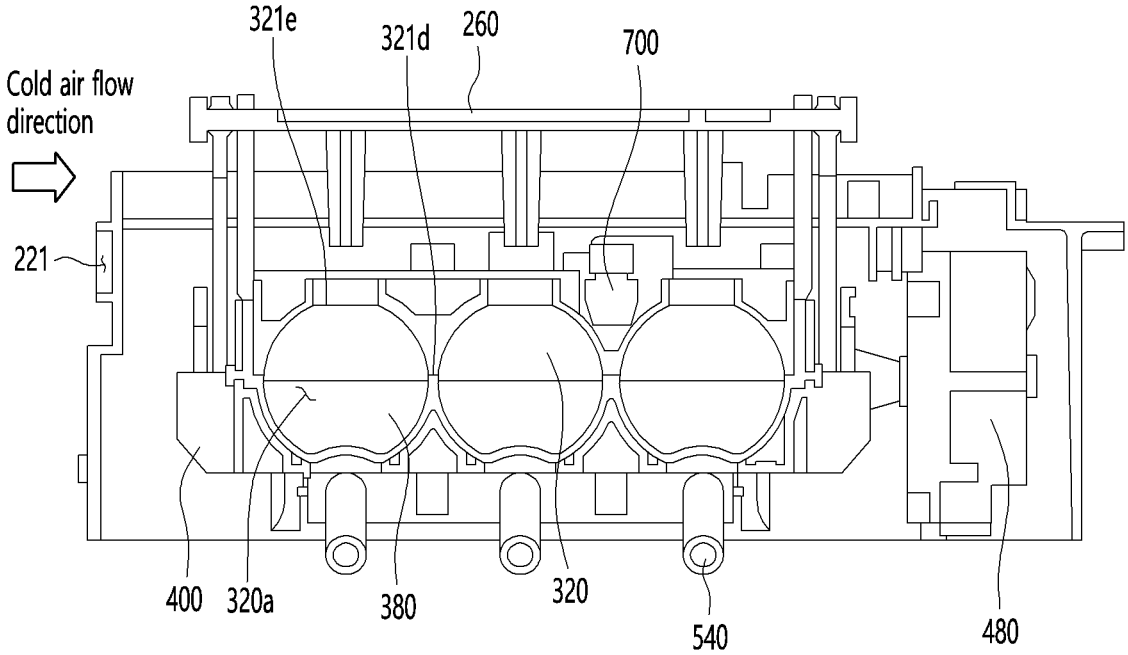
FIG. 6 is a cross-sectional view taken along line 6-6 of FIG. 2 so as to show a second temperature sensor that is in contact with a first tray according to an embodiment of the present invention.
Figure 7:
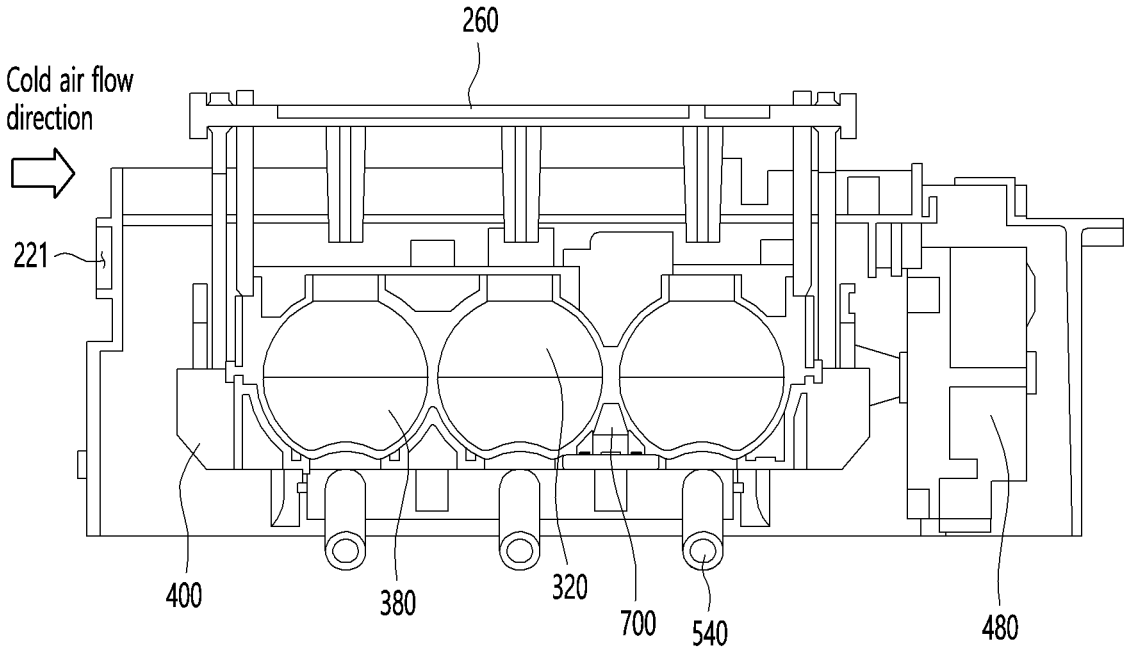
FIG. 7 is a cross-sectional view taken along line 6-6 of FIG. 2 so as to show a second temperature sensor that is in contact with a second tray according to an embodiment of the present invention.

FIG. 5 is a cross-sectional view taken along line A-A of FIG. 3 so as to show a second temperature sensor installed in the ice maker according to an embodiment of the present invention, FIG. 6 is a cross-sectional view taken along line 6-6 of FIG. 2 so as to show a second temperature sensor that is in contact with a first tray according to an embodiment of the present invention, and FIG. 7 is a cross-sectional view taken along line 6-6 of FIG. 2 so as to show a second temperature sensor that is in contact with a second tray according to an embodiment of the present invention.

Figure 8:
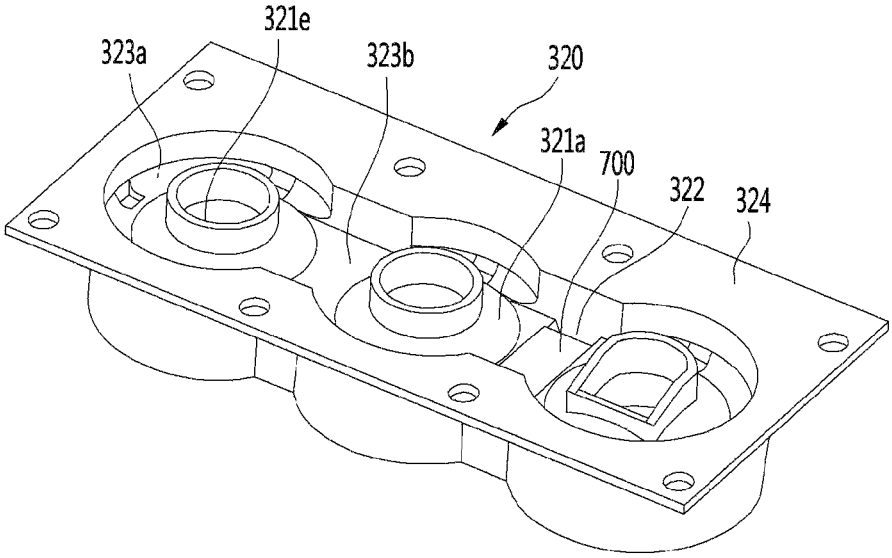
FIG. 8 is a perspective view of the first tray according to an embodiment of the present invention.
Figure 9:
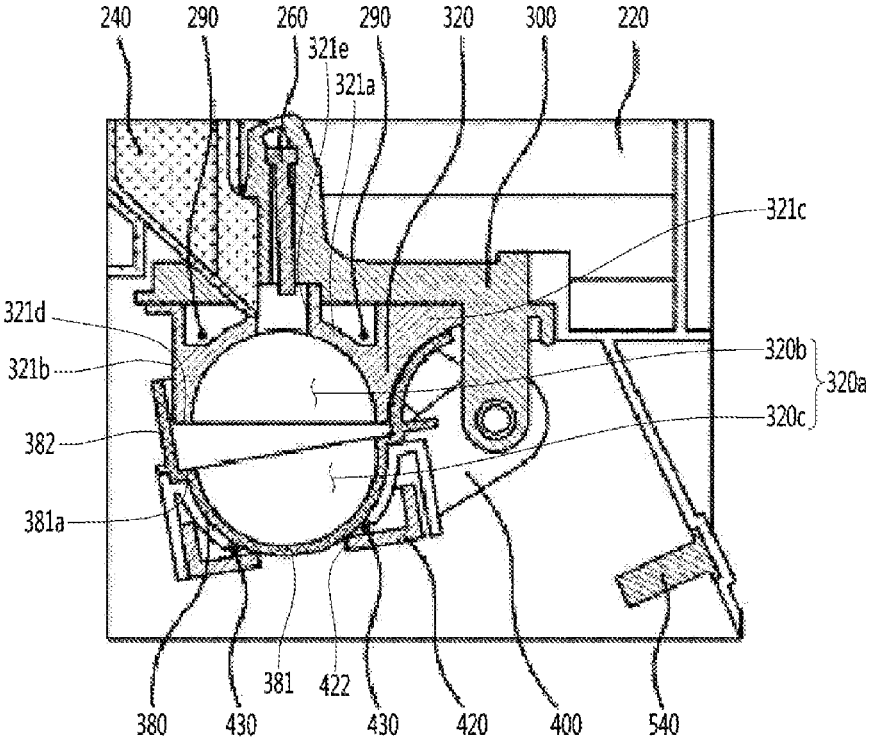
FIG. 9 is a longitudinal cross-sectional view of an ice maker when the second tray is disposed at a water supply position according to an embodiment of the present invention.

FIG. 8 is a perspective view of the first tray according to an embodiment of the present invention, and FIG. 9 is a longitudinal cross-sectional view of an ice maker when the second tray is disposed at a water supply position according to an embodiment of the present invention.

Referring to FIGS. 2 to 9, each component of the ice maker 200 may be provided inside or outside the bracket 220, and thus, the ice maker 200 may constitute one assembly.

The bracket 220 may be installed at, for example, the upper wall of the freezing compartment 32. A cold air hole 221 through which cold air flows from a cold air supply part 900 (see FIG. 10) to be described later may be formed at one side of the bracket 220. The water supply part 240 may be installed on an upper side of an inner surface of the bracket 220. The water supply part 240 may be provided with an opening in each of an upper side and a lower side to guide water, which is supplied to an upper side of the water supply part 240, to a lower side of the water supply part 240. The upper opening of the water supply part 240 may be greater than the lower opening to limit a discharge range of water guided downward through the water supply part 240. A water supply pipe through which water is supplied may be installed to the upper side of the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

The ice maker 200 may include an ice making cell 320*a* in which water is phase-changed into ice by the cold air.

The ice maker 200 may include a first tray 320 defining at least a portion of a wall providing the ice making cell 320*a* and a second tray 380 defining at least the other portion of a wall providing the ice making cell 320*a*.

Although not limited, the ice making cell 320*a* may include a first cell 320*b* and a second cell 320*c*. The first tray 320 may define the first cell 320*b*, and the second tray 380 may define the second cell 320*c*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 are in contact with each other, the complete ice making cell see 320*a* may be defined.

On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is defined. Accordingly, the first tray 320 may be referred to as an upper tray, and the second tray 380 may be referred to as a lower tray.

A plurality of ice making cells 320*a* may be defined by the first tray 320 and the second tray 380. In FIG. 6, for example, three ice making cells 320*a* are provided.

When water is cooled by cold air while water is supplied to the ice making cell 320*a*, ice having the same or similar shape as that of the ice making cell 320*a* may be made.

In this embodiment, for example, the ice making cell 320*a* may be provided in a spherical shape or a shape similar to a spherical shape. In this case, the first cell 320*b* may be provided in a hemisphere shape or a shape similar to the hemisphere. Also, the second cell 320*c* may be provided in a hemisphere shape or a shape similar to the hemisphere. The ice making cell 320*a* may have a rectangular parallelepiped shape or a polygonal shape.

The ice maker 200 may further include a first tray case 300 coupled to the first tray 320.

For example, the first tray case 300 may be coupled to an upper side of the first tray 320. The first tray case 300 may be manufactured as a separate part from the bracket 220 and then may be coupled to the bracket 220 or integrally formed with the bracket 220.

The ice maker 200 may further include a first heater case 280. An ice separation heater 290 may be installed in the second heater case 280. The heater case 280 may be integrally formed with the first tray case 300 or may be separately formed. The ice separation heater 290 may be disposed at a position adjacent to the first tray 320. For example, the ice separation heater 290 may be a wire-type heater. For example, the ice separation heater 290 may be installed to contact the second tray 320 or may be disposed at a position spaced a predetermined distance from the second tray 320. In some cases, the ice separation heater 290 may supply heat to the first tray 320, and the heat supplied to the first tray 320 may be transferred to the ice making cell 320*a*.

The ice maker 200 may further include a first tray cover 340 disposed below the first tray 320. The first tray cover 340 may be provided with an opening corresponding to a shape of the ice making cell 320*a* of the first tray 320 and may be coupled to a bottom surface of the first tray 320.

The first tray case 300 may be provided with a guide slot 302 which is inclined at an upper side and vertically extended at a lower side thereof. The guide slot 302 may be provided in a member extending upward from the first tray case 300.

A guide protrusion 266 of the first pusher 260 to be described later may be inserted into the guide slot 302. Thus, the guide protrusion 266 may be guided along the guide slot 302.

The first pusher 260 may include at least one extension part 264. For example, the first pusher 260 may include an extension part 264 provided with the same number as the number of ice making cells 320*a*, but is not limited thereto. The extension part 264 may push out the ice disposed in the ice making cell 320*a* during the ice separation process. Accordingly, the extension part 264 may be inserted into the ice making cell 320*a* through the first tray case 300. Therefore, the first tray case 300 may be provided with a hole 304 through which a portion of the first pusher 260 passes.

The guide protrusion 266 of the first pusher 260 may be coupled to the pusher link 500. In this case, the guide protrusion 266 may be coupled to the pusher link 500 so as to be rotatable. Therefore, when the pusher link 500 moves, the first pusher 260 may also move along the guide slot 302.

The ice maker 200 may further include a second tray case 400 coupled to the second tray 380. The second tray case 400 may be disposed at a lower side of the second tray to support the second tray 380. For example, at least a portion of the wall defining a second cell 320*c* of the second tray 380 may be supported by the second tray case 400.

A spring 402 may be connected to one side of the second tray case 400. The spring 402 may provide elastic force to the second tray case 400 to maintain a state in which the second tray 380 contacts the first tray 320.

The ice maker 200 may further include a second tray cover 360.

The second tray 380 may include a circumferential wall 382 surrounding a portion of the first tray 320 in a state of contacting the first tray 320. The second tray cover 360 may surround the circumferential wall 382.

The ice maker 200 may further include a second heater case 420. A transparent ice heater 430 may be installed in the second heater case 420.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which an ice making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

Alternatively, at least one of the first tray 320 and the second tray 380 may be made of a resin including plastic so that the ice attached to the trays 320 and 380 is separated in the ice making process.

At least one of the first tray 320 or the second tray 380 may be made of a flexible or soft material so that the tray deformed by the pushers 260 and 540 is easily restored to its original shape in the ice separation process.

The transparent ice heater 430 may be disposed at a position adjacent to the second tray 380. For example, the transparent ice heater 430 may be a wire-type heater. For example, the transparent ice heater 430 may be installed to contact the second tray 380 or may be disposed at a position spaced a predetermined distance from the second tray 380. For another example, the second heater case 420 may not be separately provided, but the transparent heater 430 may be installed on the second tray case 400. In some cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480.

A through-hole 282 may be defined in an extension part 281 extending downward in one side of the first tray case 300. A through-hole 404 may be defined in the extension part 403 extending in one side of the second tray case 400. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480.

One end of the rotation arm 460 may be connected to one end of the spring 402, and thus, a position of the rotation arm 460 may move to an initial value by restoring force when the spring 402 is tensioned.

The driver 480 may include a motor and a plurality of gears.

A full ice detection lever 520 may be connected to the driver 480. The full ice detection lever 520 may also rotate by the rotational force provided by the driver 480.

The full ice detection lever 520 may have a '⊏' shape as a whole. For example, the full ice detection lever 520 may include a first portion 521 and a pair of second portions 522 extending in a direction crossing the first portion 521 at both ends of the first portion 521. One of the pair of second portions 522 may be coupled to the driver 480, and the other may be coupled to the bracket 220 or the first tray case 300. The full ice detection lever 520 may rotate to detect ice stored in the ice bin 600.

The driver 480 may further include a cam that rotates by the rotational power of the motor.

The ice maker 200 may further include a sensor that senses the rotation of the cam.

For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal.

The controller 800 to be described later may determine a position of the second tray 380 based on the type and pattern of the signal outputted from the sensor. That is, since the second tray 380 and the cam rotate by the motor, the position of the second tray 380 may be indirectly determined based on a detection signal of the magnet provided in the cam.

For example, a water supply position and an ice making position, which will be described later, may be distinguished and determined based on the signals outputted from the sensor.

The ice maker 200 may further include a second pusher 540. The second pusher 540 may be installed on the bracket 220. The second pusher 540 may include at least one extension part 544. For example, the second pusher 540 may include an extension part 544 provided with the same number as the number of ice making cells 320*a*, but is not limited thereto. The extension part 544 may push the ice disposed in the ice making cell 320*a*. For example, the extension part 544 may pass through the second tray case 400 to contact the second tray 380 defining the ice making cell and then press the contacting second tray 380. Therefore, the second tray case 400 may be provided with a hole 422 through which a portion of the second pusher 540 passes.

The first tray case 300 may be rotatably coupled to the second tray case 400 with respect to the second tray supporter 400 and then be disposed to change in angle about the shaft 440.

In this embodiment, the second tray 380 may be made of a non-metal material. For example, when the second tray 380 is pressed by the second pusher 540, the second tray 380 may be made of a flexible or soft material which is deformable. Although not limited, the second tray 380 may be made of, for example, a silicone material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metallic material and the flexible or soft material, the coupling force or attaching force between the ice and the second tray 380 may be reduced, and thus, the ice may be easily separated from the second tray 380.

Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

The first tray 320 may be made of a metal material. In this case, since the coupling force or the attaching force between the first tray 320 and the ice is strong, the ice maker 200 according to this embodiment may include at least one of the ice separation heater 290 or the first pusher 260.

For another example, the first tray 320 may be made of a non-metallic material. When the first tray 320 is made of the non-metallic material, the ice maker 200 may include only one of the ice separation heater 290 and the first pusher 260. Alternatively, the ice maker 200 may not include the ice separation heater 290 and the first pusher 260. Although not limited, the first tray 320 may be made of, for example, a silicone material. That is, the first tray 320 and the second tray 380 may be made of the same material.

When the first tray 320 and the second tray 380 are made of the same material, the first tray 320 and the second tray 380 may have different hardness to maintain sealing performance at the contact portion between the first tray 320 and the second tray 380. In this embodiment, since the second tray 380 is pressed by the second pusher 540 to be deformed, the second tray 380 may have hardness less than that of the first tray 320 to facilitate the deformation of the second tray 380.

Referring to FIGS. 5 and 6, the ice maker 200 may further include a second temperature sensor 700 (or tray temperature sensor) for detecting a temperature of the ice making cell 320*a*. The second temperature sensor 700 may sense a temperature of water or ice of the ice making cell 320*a*.

In detail, the second temperature sensor 700 may be disposed adjacent to at least one of the first tray 320 or the second tray 380 to detect a temperature of the tray, thereby indirectly detecting a temperature of water or ice of the ice making cell 320*a*.

For example, the second temperature sensor 700 may be in contact with the first tray 320 as illustrated in FIG. 6 or may be in contact with the second tray 380 as illustrated in FIG. 7.

In this embodiment, the water temperature or the ice temperature of the ice making cell 320*a* may be referred to as an internal temperature of the ice making cell 320*a*.

For example, the second temperature sensor 700 may be installed in the first tray case 300. In this case, the second temperature sensor 700 may contact the first tray 320 or may be spaced a predetermined distance from the first tray 320. For another example, the second temperature sensor 700 may be installed in the first tray 320 to be in contact with the first tray 320.

Alternatively, when the second temperature sensor 700 may be disposed to pass through the first tray 320, the temperature of the water or the temperature of the ice of the ice making cell 320*a* may be directly detected.

Referring to FIG. 8, the first tray 320 may further include a sensor accommodation part 322 accommodating the second temperature sensor 700. The sensor accommodation part 321*e* may be recessed downward from the case accommodation part 321*b*.

Here, a bottom surface of the sensor accommodation part 321 may be disposed at a position lower than that of the bottom surface of the heater accommodation part 321*a* to prevent the second temperature sensor 700 from interfering with the ice separation heater 290 in a state in which the second temperature sensor 700 is accommodated in the sensor accommodation part 321. The bottom surface of the sensor accommodation part 321 may be disposed closer to the bottom surface 321*d* of the first tray 320 than the bottom surface of the heater accommodation part 321*a*.

In addition, in a state in which the second temperature sensor 700 is accommodated in the sensor accommodation part 322, the second temperature sensor 700 may be disposed lower than the plate 324 of the first tray 320, or the top surface of the second temperature sensor 700 may be in contact with the heater case 280.

At least a portion of the second temperature sensor 700 may be in contact with the bottom surface of the sensor accommodation part 322. Although not limited, the second temperature sensor 700 may be directly accommodated in the sensor accommodation part 322.

Alternatively, the second temperature sensor 700 may be installed in the heater case 280. In this case, when the ice separation heater 290 of the heater case 280 is accommodated in the heater accommodation part 323*a*, the second temperature sensor 700 may be accommodated in the sensor accommodation part 322.

The sensor accommodation part 322 may be disposed between two adjacent ice making cells 320*a*. When the sensor accommodation part 322 is disposed between the two ice making cells 320*a*, the second temperature sensor 700 may be easily installed without increasing the volume of the first tray 320. Also, when the sensor accommodation part 322 is disposed between the two ice making cells 320*a*, the temperatures of at least two ice making cells 320*a* may be affected. Thus, the temperature sensor may be disposed so that the temperature sensed by the second temperature sensor maximally approaches an actual temperature inside the cell 320*a*.

For example, the sensor accommodation part 322 may be disposed between two adjacent upper cells 320*b* (or first cells) among three upper cells 320*b* arranged side by side.

As a result, the second temperature sensor 700 may represent the temperatures of both the first tray 320 and the second tray 380 and minimize an exposure of the second temperature sensor 700 to the outside so that it is affected as little as possible from the external temperature.

The second temperature sensor 700 may be disposed between the first cell walls 321*a* (see FIG. 9) of the two ice making cells 320*a* of the first tray 320 as illustrated in FIG. 6 so as to be in contact with the first tray 320 at the outside of the first cell walls 321*a*.

Also, the second temperature sensor 700 may measure a temperature of the cell that is frozen last among the plurality of ice making cells 320*a*, thereby preventing ice from being separated in a state in which the ice separation is not completed.

The cell that is frozen last among the plurality of ice making cells 320*a* may be an ice making cell 320*a* that is disposed farthest from the cold air supply part 900 in a direction in which the cold air is supplied.

Also, the second temperature sensor 700 may be disposed so that a distance between the cold air hole 221 and the second temperature sensor 700 is less than a distance between the ice making cell, which is farthest from the cold air hole 221 for supplying the cold air by the cold air supply part 900, and the cold air hole 221 among the plurality of ice making cells 320*a*.

In FIGS. 6 and 7, the sensor accommodation part 322 may be disposed between the right ice making cell (or the first ice making cell) and the central ice making cell (or the second ice making cell) of both right and left sides of the three ice making cells to accommodate at least a portion of the second temperature sensor 700.

Also, when the sensor accommodation part 322 is disposed between the upper cell and the central upper cell of both the left and right sides in the three upper cells 320*b*, a distance between the right upper cell and the central upper cell is greater than a distance between the left upper cell and the central upper cell. This is done for providing a seat on which the second temperature sensor 700 is accommodated.

The second temperature sensor 700 may be disposed adjacent to the second tray 380 and may also be disposed between the plurality of lower cells 320*c*.

The wire 701 connected to the second temperature sensor 700 may be guided to an upper side of the first tray case 300. Thus, in order to prevent an interference due to the electric wire 701 and to prevent the electric wire 701 from being broken due to deformation, the second temperature sensor 700 may be mounted on the tray that does not rotate by the driver 480 among the first tray 320 and the second tray 280. That is, the second temperature sensor 700 may be mounted on the first tray 320 that is fixed without rotating by the driver 480.

When the second temperature sensor 700 is mounted adjacent to the transparent ice heater 430, there is a possibility that accuracy at a time point at which the ice making is completed is deteriorated due to the heat supplied from the transparent ice heater 430.

Also, the transparent ice heater 430 causes lower water to be frozen later than upper water, and thus, a temperature change may hardly occur during the ice making process, and the phase change temperature may be maintained. Thus, if the second temperature sensor 700 is mounted adjacent to the tray that is in contact with the transparent ice heater 430, the temperature change of the temperature sensor during the ice making process is not large, and thus, it may be difficult to adjust a heating amount of the transparent ice heater 430 in stages.

Thus, the second temperature sensor 700 may be mounted on the tray that is disposed farther from the transparent ice heater 430 so as to be less affected by the transparent ice heater 430.

A portion of the ice separation heater 290 may be disposed higher than the second temperature sensor 700 and may be spaced apart from the second temperature sensor 700.

Also, the second temperature sensor 700 may be provided in the first heater case 280 together with the ice separation heater 290. Here, the reliability of the second temperature sensor 700 may be secured only when the second temperature sensor 700 and the ice separation heater 290 are spaced apart from each other.

Referring to FIG. 9, the ice maker 200 according to this embodiment may be designed so that a position of the second tray 380 is different from the water supply position and the ice making position.

For example, the second tray 380 may include a second cell wall 381 defining a second cell 320*c* of the ice making cell 320*a* and a circumferential wall 382 extending along an outer edge of the second cell wall 381.

The second cell wall 381 may include a top surface 381*a*. The top surface 381*a* of the second cell wall 381 may be referred to as a top surface 381*a* of the second tray 380. The top surface 381*a* of the second cell wall 381 may be disposed lower than an upper end of the circumferential wall 381.

The first tray 320 may include a first cell wall 321*a* defining a first cell 320*b* of the ice making cell 320*a*. The first cell wall 321*a* may include a straight portion 321*b* and a curved portion 321*c*. The curved portion 321*c* may have an arc shape having a radius of curvature at the center of the shaft 440. Accordingly, the circumferential wall 381 may also include a straight portion and a curved portion corresponding to the straight portion 321*b* and the curved portion 321*c*.

The first cell wall 321*a* may include a bottom surface 321*d*. The bottom surface 321*b* of the first cell wall 321*a* may be referred to herein as a bottom surface 321*b* of the first tray 320. The bottom surface 321*d* of the first cell wall 321*a* may be in contact with the top surface 381*a* of the second cell wall 381*a*.

For example, at the water supply position as illustrated in FIG. 9, at least portions of the bottom surface 321*d* of the first cell wall 321*a* and the top surface 381*a* of the second cell wall 381 may be spaced apart from each other.

FIG. 9 illustrates that the entirety of the bottom surface 321*d* of the first cell wall 321*a* and the top surface 381*a* of the second cell wall 381 are spaced apart from each other. Accordingly, the top surface 381*a* of the second cell wall 381 may be inclined to form a predetermined angle with respect to the bottom surface 321*d* of the first cell wall 321*a*.

Although not limited, the bottom surface 321*d* of the first cell wall 321*a* may be substantially horizontal at the water supply position, and the top surface 381*a* of the second cell wall 381 may be disposed below the first cell wall 321*a* to be inclined with respect to the bottom surface 321*d* of the first cell wall 321*a*.

In the state of FIG. 9, the circumferential wall 382 may surround the first cell wall 321*a*. Also, an upper end of the circumferential wall 382 may be positioned higher than the bottom surface 321*d* of the first cell wall 321*a*.

At the ice making position (see FIG. 13), the top surface 381*a* of the second cell wall 381 may contact at least a portion of the bottom surface 321*d* of the first cell wall 321*a*.

The angle formed between the top surface 381*a* of the second tray 380 and the bottom surface 321*d* of the first tray 320 at the ice making position is less than that between the top surface 382*a* of the second tray and the bottom surface 321*d* of the first tray at the water supply position.

At the ice making position, the top surface 381*a* of the second cell wall 381 may contact all of the bottom surface 321*d* of the first cell wall 321*a*.

At the ice making position, the top surface 381*a* of the second cell wall 381 and the bottom surface 321*d* of the first cell wall 321*a* may be disposed to be substantially parallel to each other.

In this embodiment, the water supply position of the second tray 380 and the ice making position are different from each other. This is done for uniformly distributing the water to the plurality of ice making cells 320*a* without providing a water passage for the first tray 320 and/or the second tray 380 when the ice maker 200 includes the plurality of ice making cells 320*a*.

If the ice maker 200 includes the plurality of ice making cells 320*a*, when the water passage is provided in the first tray 320 and/or the second tray 380, the water supplied into the ice maker 200 may be distributed to the plurality of ice making cells 320*a* along the water passage.

However, when the water is distributed to the plurality of ice making cells 320*a*, the water also exists in the water passage, and when ice is made in this state, the ice made in the ice making cells 320*a* may be connected by the ice made in the water passage portion.

In this case, there is a possibility that the ice sticks to each other even after the completion of the ice, and even if the ice is separated from each other, some of the plurality of ice includes ice made in a portion of the water passage. Thus, the ice may have a shape different from that of the ice making cell.

However, like this embodiment, when the second tray 380 is spaced apart from the first tray 320 at the water supply position, water dropping to the second tray 380 may be uniformly distributed to the plurality of second cells 320*c* of the second tray 380.

For example, the first tray 320 may include a communication hole 321*e*. When the first tray 320 includes one first cell 320*b*, the first tray 320 may include one communication hole 321*e*.

When the first tray 320 includes a plurality of first cells 320*b*, the first tray 320 may include a plurality of communication holes 321*e*. The water supply part 240 may supply water to one communication hole 321*e* of the plurality of communication holes 321*e*. In this case, the water supplied through the one communication hole 321*e* drops to the second tray 380 after passing through the first tray 320.

In the water supply process, water may drop into any one of the second cells 320*c* of the plurality of second cells 320*c* of the second tray 380. The water supplied to one of the second cells 320*c* may overflow from the one of the second cells 320*c*.

In this embodiment, since the top surface 381*a* of the second tray 380 is spaced apart from the bottom surface 321*d* of the first tray 320, the water overflowed from any one of the second cells 320*c* may move to the adjacent other second ell 320*c* along the top surface 381*a* of the second tray 380. Therefore, the plurality of second cells 320*c* of the second tray 380 may be filled with water.

Also, in the state in which water supply is completed, a portion of the water supplied may be filled in the second cell 320*c*, and the other portion of the water supplied may be filled in the space between the first tray 320 and the second tray 380.

Figure 12:
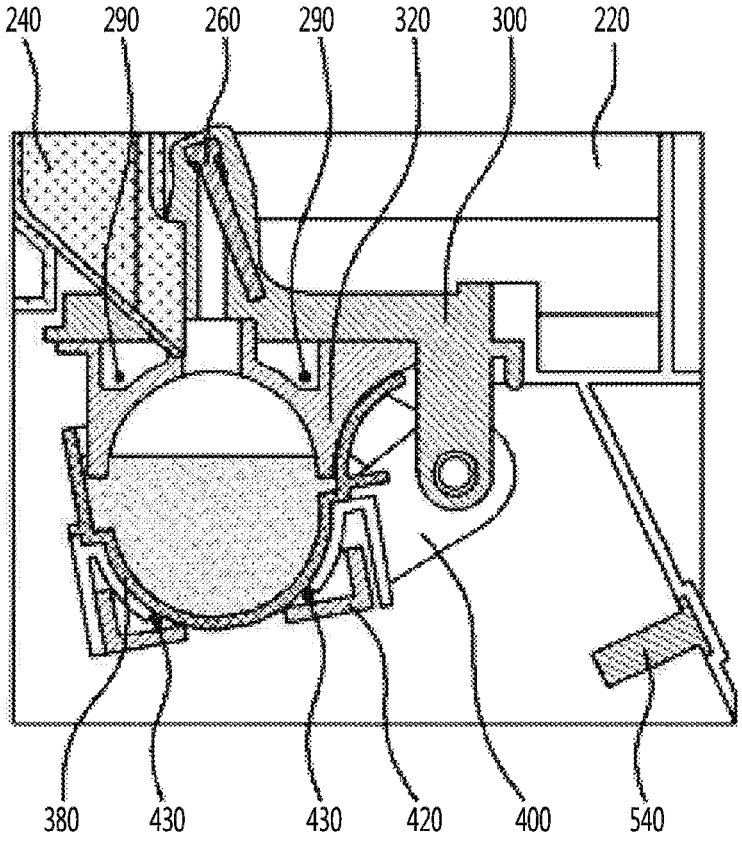
FIG. 12 is a view illustrating a state in which supply of water is completed at a water supply position.

At the water supply position, according to a volume of the ice making cell 320*a*, the water when the water supply is completed may be disposed only in the space between the first tray 320 and the second tray 380 or may also be disposed in the space between the second tray 380 and the first tray 320 (see FIG. 12).

When the second tray 380 move from the water supply position to the ice making position, the water in the space between the first tray 320 and the second tray 380 may be uniformly distributed to the plurality of first cells 320*b*.

When water passages are provided in the first tray 320 and/or the second tray 380, ice made in the ice making cell 320*a* may also be made in a portion of the water passage.

In this case, when the controller of the refrigerator controls one or more of the cooling power of the cold air supply part 900 and the heating amount of the transparent ice heater to vary according to the mass per unit height of the water in the ice making cell 320*a*, one or more of the cooling power of the cold air supply part 900 and the heating amount of the transparent ice heater may be abruptly changed several times or more in the portion at which the water passage is provided.

This is because the mass per unit height of the water increases more than several times in the portion at which the water passage is provided. In this case, reliability problems of components may occur, and expensive components having large maximum output and minimum output ranges may be used, which may be disadvantageous in terms of power consumption and component costs. As a result, the present invention may require the technique related to the aforementioned ice making position to make the transparent ice.

Figure 10:
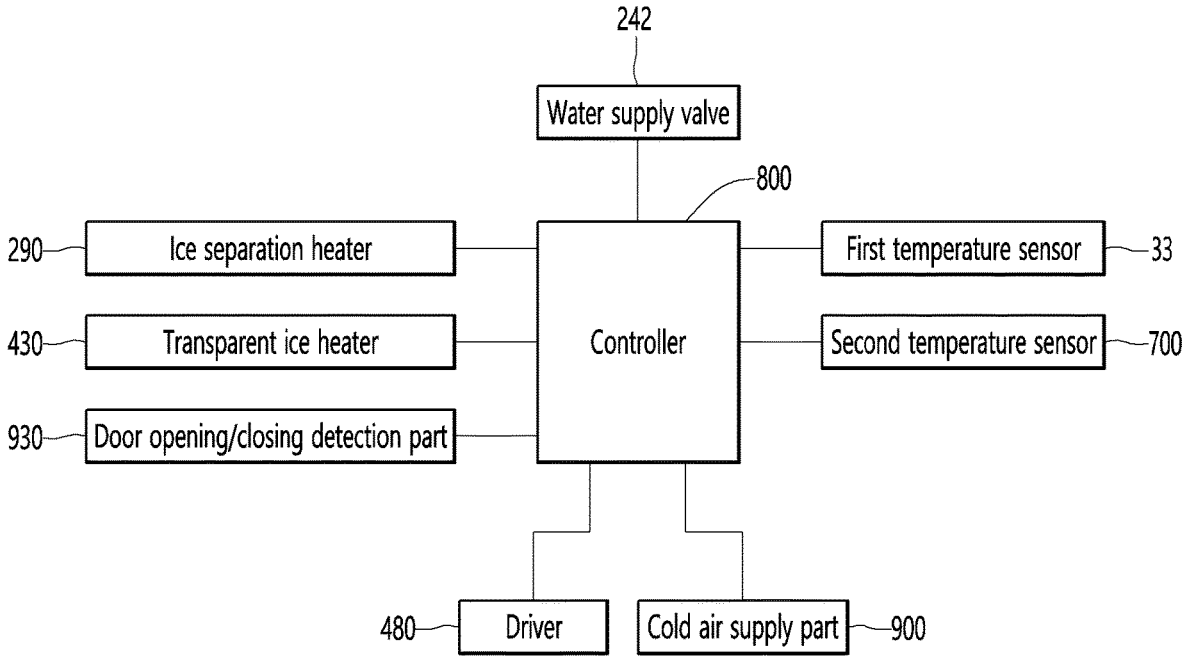
FIG. 10 is a control block diagram of a refrigerator according to an embodiment of the present invention.

FIG. 10 is a control block diagram of the refrigerator according to an embodiment.

Referring to FIG. 10, the refrigerator according to this embodiment may include an air supply part 900 supplying cold air to the freezing compartment 32 (or the ice making cell). The cold air supply part 900 may supply cold air to the freezing compartment 32 using a refrigerant cycle.

For example, the cold air supply part 900 may include a compressor compressing the refrigerant. A temperature of the cold air supplied to the freezing compartment 32 may vary according to the output (or frequency) of the compressor. Alternatively, the cold air supply part 900 may include a fan blowing air to an evaporator. An amount of cold air supplied to the freezing compartment 32 may vary according to the output (or rotation rate) of the fan. Alternatively, the cold air supply part 900 may include a refrigerant valve controlling an amount of refrigerant flowing through the refrigerant cycle. An amount of refrigerant flowing through the refrigerant cycle may vary by adjusting an opening degree by the refrigerant valve, and thus, the temperature of the cold air supplied to the freezing compartment 32 may vary.

Therefore, in this embodiment, the cold air supply part 900 may include one or more of the compressor, the fan, and the refrigerant valve.

The refrigerator according to this embodiment may further include a controller 800 that controls the cold air supply part 900. Also, the refrigerator may further include a water supply valve 242 controlling an amount of water supplied through the water supply part 240.

The refrigerator may further include a door opening/closing detection part 930 for detecting an opening/closing of a door of a storage chamber (for example, the freezing compartment 32) in which the ice maker 200 is installed.

The controller 800 may control a portion or all of the ice separation heater 290, the transparent ice heater 430, the driver 480, the cold air supply part 900, and the water supply valve 242.

When the door opening/closing detection part 930 detects the opening/closing of the door (a state in which the door is opened and closed), the controller 800 may determine whether cooling power of the cold air supply part 900 is variable.

When the door opening/closing detection part 930 detects the opening/closing of the door, the controller 800 determines whether an output of the transparent ice heater 430 is variable based on a temperature detected by the second temperature sensor 700.

In this embodiment, when the ice maker 200 includes both the ice separation heater 290 and the transparent ice heater 430, an output of the ice separation heater 290 and an output of the transparent ice heater 430 may be different from each other.

When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented. Although not limited, the output of the ice separation heater 290 may be set larger than that of the transparent ice heater 430. Accordingly, ice may be quickly separated from the first tray 320 by the ice separation heater 290.

In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor 33 (or a temperature sensor in the refrigerator) that detects a temperature of the freezing compartment 32.

The controller 800 may control the cold air supply part 900 based on the temperature detected by the first temperature sensor 33.

The controller 800 may determine whether the ice making is completed based on the temperature detected by the second temperature sensor 700.

Figure 11:
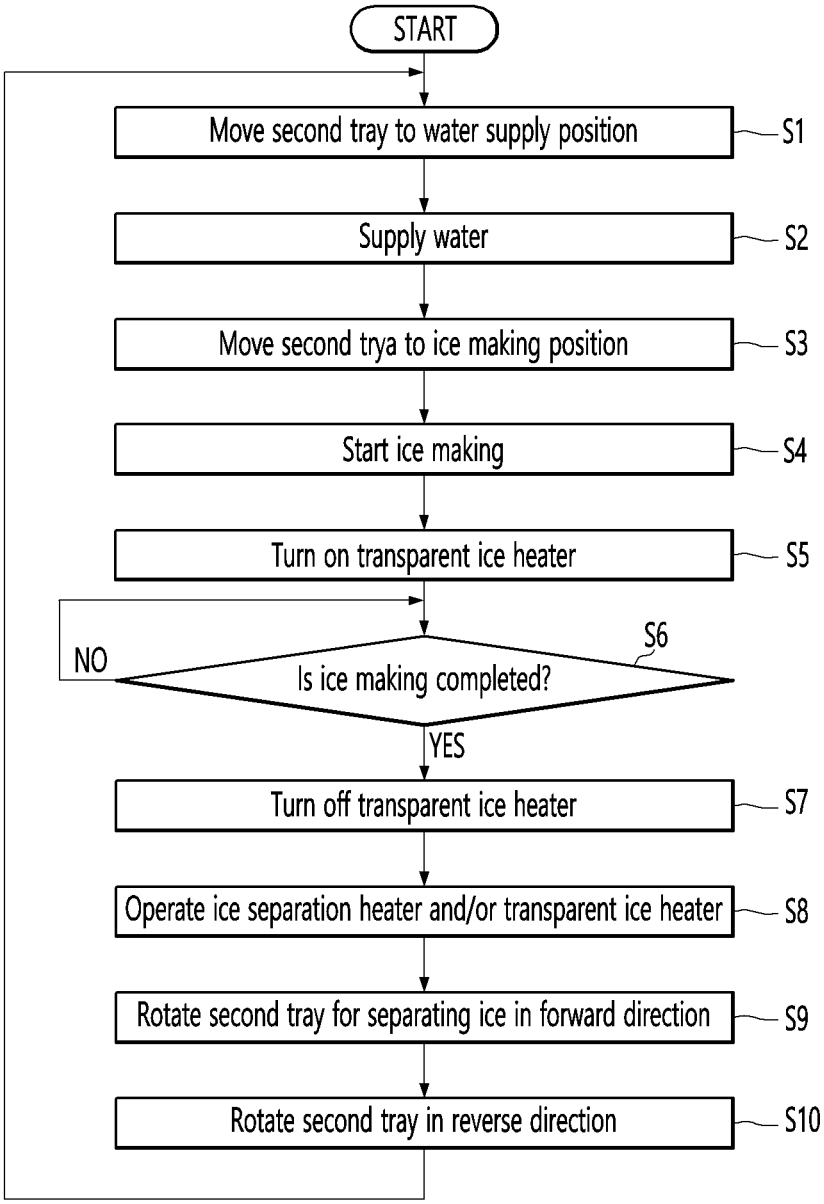
FIG. 11 is a flowchart for explaining a process of making ice in the ice maker according to an embodiment of the present invention.

FIG. 11 is a flowchart for explaining a process of making ice in the ice maker according to an embodiment.

Figure 13:
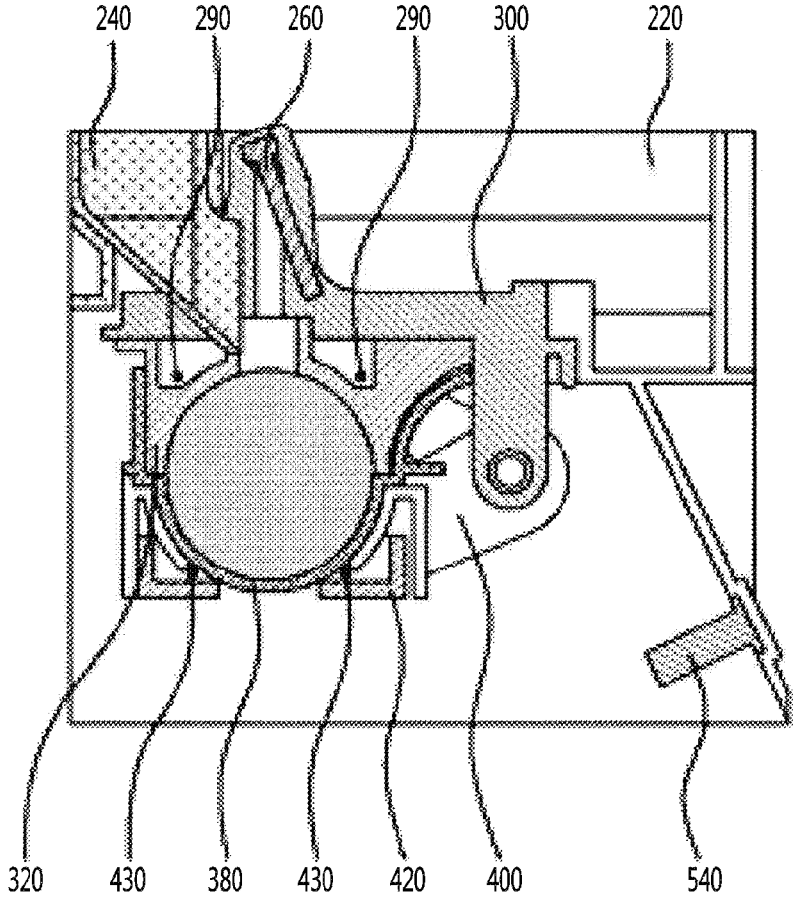
FIG. 13 is a view illustrating a state in which ice is generated at an ice making position.
Figure 14:
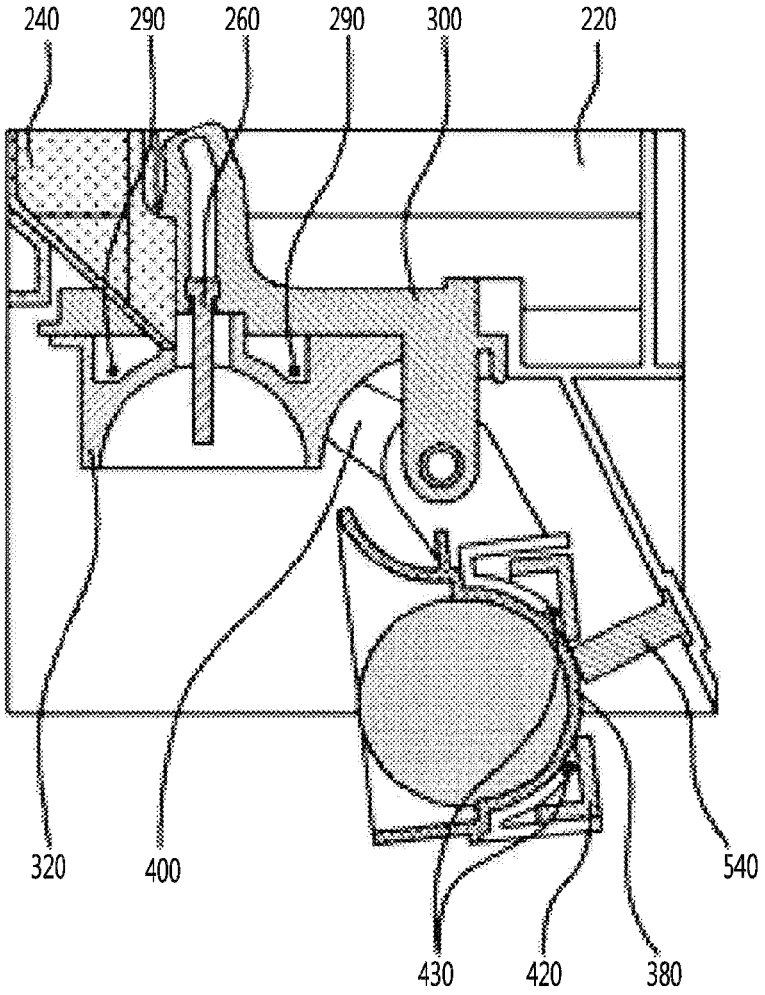
FIG. 14 is a view illustrating a state in which a second tray and a first tray are separated from each other in an ice separation process.

FIG. 12 is a view illustrating a state in which supply of water is completed at the water supply position, FIG. 13 is a view illustrating a state in which ice is generated at the ice making position. FIG. 14 is a view illustrating a state in which the second tray and the first tray are separated from each other in the ice separation process, and FIG. 15 is a view illustrating a state in which the second tray moves to the ice separation position in the ice separation process.

Referring to FIGS. 11 to 15, to make ice in the ice maker 200, the controller 800 moves the second tray 380 to a water supply position (S1).

Figure 15:
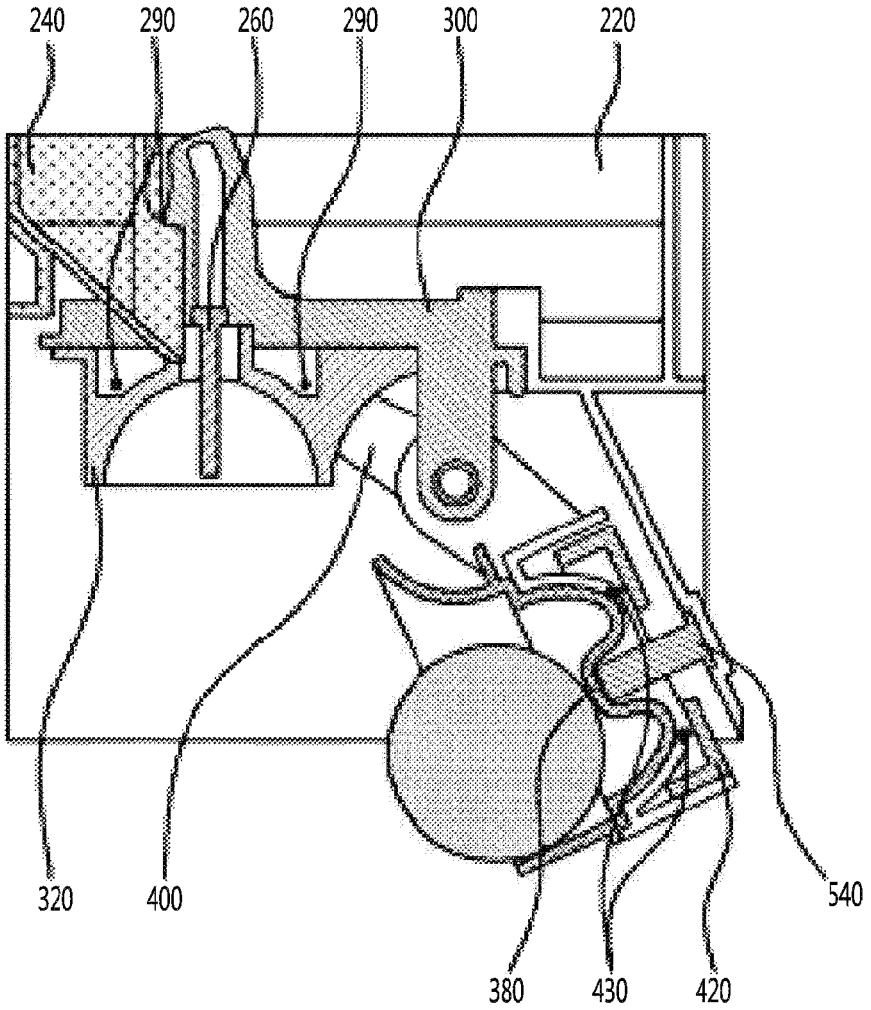
FIG. 15 is a view illustrating a state in which the second tray moves to an ice separation position in the ice separation process.

In this specification, a direction in which the second tray 380 moves from the ice making position of FIG. 13 to the ice separation position of FIG. 15 may be referred to as forward movement (or forward rotation). On the other hand, the direction from the ice separation position of FIG. 15 to the water supply position of FIG. 9 may be referred to as reverse movement (or reverse rotation).

The movement to the water supply position of the second tray 380 is detected by a sensor, and when it is detected that the second tray 380 moves to the water supply position, the controller 800 stops the driver 480.

In the state in which the second tray 380 moves to the water supply position, the water supply starts (S2). For the water supply, the controller 800 turns on the water supply valve 242, and when it is determined that a predetermined amount of water is supplied, the controller 800 may turn off the water supply valve 242.

For example, in the process of supplying water, when a pulse is outputted from a flow sensor (not shown), and the outputted pulse reaches a reference pulse, it may be determined that a predetermined amount of water is supplied.

After the water supply is completed, the controller 800 controls the driver 480 to allow the second tray 380 to move to the ice making position (S3).

For example, the controller 800 may control the driver 480 to allow the second tray 380 to move from the water supply position in the reverse direction. When the second tray 380 move in the reverse direction, the top surface 381*a* of the second tray 380 comes close to the bottom surface 321*e* of the first tray 320. Then, water between the top surface 381*a* of the second tray 380 and the bottom surface

321*e* of the first tray 320 is divided into each of the plurality of second cells 320*c* and then is distributed. When the top surface 381*a* of the second tray 380 and the bottom surface 321*e* of the first tray 320 contact each other, water is filled in the first cell 320*b*.

The movement to the ice making position of the second tray 380 is detected by a sensor, and when it is detected that the second tray 380 moves to the ice making position, the controller 800 stops the driver 480.

In the state in which the second tray 380 moves to the ice making position, ice making is started (S4). For example, the ice making may be started when the second tray 380 reaches the ice making position. Alternatively, when the second tray 380 reaches the ice making position, and the water supply time elapses, the ice making may be started.

When ice making is started, the controller 800 may control the cold air supply part 900 to supply cold air to the ice making cell 320*a*.

After the ice making is started, the controller 800 may control the transparent ice heater 430 to be turned on in at least partial sections of the cold air supply part 900 supplying the cold air to the ice making cell 320*a* (S5).

When the transparent ice heater 430 is turned on, since the heat of the transparent ice heater 430 is transferred to the ice making cell 320*a*, the ice making rate of the ice making cell 320*a* may be delayed.

According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied.

In this embodiment, the transparent ice heater 430 is not turned on immediately after the ice making is started, and the transparent ice heater 430 may be turned on only when the turn-on condition of the transparent ice heater 430 is satisfied.

Generally, the water supplied to the ice making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice.

If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice.

Thus, according to this embodiment, after the turn-on condition of the transparent ice heater 430 is satisfied, when the transparent ice heater 430 is turned on, power consumption due to the unnecessary operation of the transparent ice heater 430 may be prevented.

Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on. For example, the specific time point may be set to a time point at which the cold air supply part 900 starts to supply cooling power for the ice making, a time point at which the second tray 380 reaches the ice making position, a time point at which the water supply is completed, and the like. Alternatively, the controller 800 determines that the turn-on condition of the transparent ice heater 430 is satisfied when a temperature detected by the second temperature sensor 700 reaches a turn-on reference temperature.

For example, the turn-on reference temperature may be a temperature for determining that water starts to freeze at the uppermost side (communication hole-side) of the ice making cell 320*a*.

When a portion of the water is frozen in the ice making cell 320*a*, the temperature of the ice in the ice making cell 320*a* is below zero. The temperature of the first tray 320 may be higher than the temperature of the ice in the ice making cell 320*a*.

Alternatively, although water exists in the ice making cell 320*a*, after the ice starts to be made in the ice making cell 320*a*, the temperature detected by the second temperature sensor 700 may be below zero.

Thus, to determine that making of ice is started in the ice making cell 320*a* on the basis of the temperature detected by the second temperature sensor 700, the turn-on reference temperature may be set to the below-zero temperature.

That is, when the temperature sensed by the second temperature sensor 700 reaches the turn-on reference temperature, since the turn-on reference temperature is below zero, the ice temperature of the ice making cell 320*a* is below zero, i.e., lower than the below reference temperature. Therefore, it may be indirectly determined that ice is made in the ice making cell 320*a*.

As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water.

Since density of water is greater than that of ice, water or bubbles may be convex in the ice making cell 320*a*, and the bubbles may move to the transparent ice heater 430.

In this embodiment, the mass (or volume) per unit height of water in the ice making cell 320*a* may be the same or different according to the shape of the ice making cell 320*a*.

For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

When the cooling power of the cold air supply part 900 is constant, if the heating amount of the transparent ice heater 430 is the same, since the mass per unit height of water in the ice making cell 320*a* is different, an ice making rate per unit height may be different.

For example, if the mass per unit height of water is small, the ice making rate is high, whereas if the mass per unit height of water is high, the ice making rate is slow.

As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency.

That is, the more the variation in ice making rate per unit height of water decreases, the more the variation in transparency per unit height of made ice may decrease.

Therefore, in this embodiment, the controller 800 may control the cooling power and/or the heating amount so that the cooling power of the cold air supply part 900 and/or the heating amount of the transparent ice heater 430 is variable according to the mass per unit height of the water of the ice making cell 320*a*.

In this specification, the cooling power of the cold air supply part 900 may include one or more of a variable output of the compressor, a variable output of the fan, and a variable opening degree of the refrigerant valve.

Also, in this specification, the variation in the heating amount of the transparent ice heater 430 may represent varying the output of the transparent ice heater 430 or varying the duty of the transparent ice heater 430.

In this case, the duty of the transparent ice heater 430 represents a ratio of the turn-on time and the turn-off time of the transparent ice heater 430 in one cycle, or a ratio of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430.

Since the ice making rate varies for the height, the transparency of the ice may vary for the height. In a specific section, the ice making rate may be too fast to contain bubbles, thereby lowering the transparency.

Therefore, in this embodiment, the output of the transparent ice heater 430 may be controlled so that the ice making rate for each unit height is the same or similar while the bubbles move from the portion at which ice is made to the water in the ice making process.

The output of the transparent ice heater 430 is gradually reduced from the first section to the intermediate section after the transparent ice heater 430 is turned on. The output of the transparent ice heater 430 may be minimum in the intermediate section in which the mass of unit height of water is minimum.

The output of the transparent ice heater 430 may again increase step by step from the next section of the intermediate section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

Even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small.

For example, while maintaining the same cooling power of the cold air supply part 900, the heating amount of the transparent ice heater 430 may vary so as to be inversely proportional to the mass per unit height of water.

Also, it is possible to make the transparent ice by varying the cooling power of the cold air supply part 900 according to the mass per unit height of water.

For example, when the mass per unit height of water is large, the cold force of the cold air supply part 900 may increase, and when the mass per unit height is small, the cold force of the cold air supply part 900 may decrease.

For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may increase step by step.

The cooling power of the cold air supply part 900 may be maximum in the intermediate section in which the mass for each unit height of water is minimum. The cooling power of the cold air supply part 900 may be reduced again step by step from the next section of the intermediate section.

Alternatively, the transparent ice may be made by varying the cooling power of the cold air supply part 900 and the heating amount of the transparent ice heater 430 according to the mass for each unit height of water.

For example, the heating power of the transparent ice heater 430 may vary so that the cooling power of the cold air supply part 900 is proportional to the mass per unit height of water and inversely proportional to the mass for each unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

The controller 800 may determine whether the ice making is completed based on the temperature detected by the second temperature sensor 700 (S6). When it is determined that the ice making is completed, the controller 800 may turn off the transparent ice heater 430 (S7).

For example, when the temperature detected by the second temperature sensor 700 reaches a first reference temperature, the controller 800 may determine that the ice making is completed to turn off the transparent ice heater 430.

In this case, since a distance between the second temperature sensor 700 and each ice making cell 320*a* is different, in order to determine that the ice making is completed in all the ice making cells 320*a*, the controller 800 may perform the ice separation after a certain amount of time, at which it is determined that ice making is completed, has passed or when the temperature detected by the second temperature sensor 700 reaches a second reference temperature lower than the first reference temperature.

When the ice making is completed, the controller 800 operates at least one or more of the ice maker heater 290 and the transparent ice heater 430 (S8).

When the ice separation heater 290 is turned on, heat of the ice separation heater 290 may be transferred to the first tray 320, and thus, the ice may be separated from a surface (an inner surface) of the first tray 320.

Also, the heat of the ice separation heater 290 is transferred to a contact surface between the first tray 320 and the second tray 380, and thus, the bottom surface 321*d* of the first tray and the top surface 381*a* of the second tray 380 may be in a state capable of being separated from each other.

After at least one or more of the ice separation heater 290 and the transparent ice heater 430 are turned on, when the moving condition of the second tray 380 is satisfied, the controller 800 may turn off the heater that is turned on and may rotate the second tray 380 in the forward direction so that the second tray 380 moves to the ice separation position (S9).

As illustrated in FIG. 14, when the second tray 380 move in the forward direction, the second tray 380 is spaced apart from the first tray 320.

The moving force of the second tray 380 is transmitted to the first pusher 260 by the pusher link 500. Then, the first pusher 260 descends along the guide slot 302, and the extension part 264 passes through the communication hole 321*e* to press the ice in the ice making cell 320*a*.

In this embodiment, ice may be separated from the first tray 320 before the extension part 264 presses the ice in the ice making process. That is, the ice may be separated from the surface of the first tray 320 by the heat of the ice separation heater 290.

In this case, the ice may move together with the second tray 380 while the ice is supported by the second tray 380.

In the operation of the ice separation heater 290, ice may not be separated from the surface of the first tray 320 even by the operation of the ice separation heater 290.

Therefore, when the second tray 380 moves in the forward direction, there is possibility that the ice is separated from the second tray 380 in a state in which the ice contacts the first tray 320.

In this state, in the process of moving the second tray 380, the extension part 264 passing through the communication hole 320*e* may press the ice contacting the first tray 320, and thus, the ice may be separated from the tray 320. The ice separated from the first tray 320 may be supported by the second tray 380.

When the ice moves together with the second tray 380 while the ice is supported by the second tray 380, the ice may be separated from the second tray 380 by its own weight even if no external force is applied to the second tray 380.

While the second tray 380 moves, even if the ice does not fall from the second tray 380 by its own weight, when the second tray 380 is pressed by the second pusher 540 as illustrated in FIG. 14, the ice may be separated from the second tray 380 to fall downward.

Particularly, as illustrated in FIG. 14, while the second tray 380 moves, the second tray 380 may contact the extension part 544 of the second pusher 540.

When the second tray 380 continuously moves in the forward direction, the extension part 544 may press the second tray 380 to deform the second tray 380 and the extension part 544. Thus, the pressing force of the extension part 544 may be transferred to the ice so that the ice is separated from the surface of the second tray 380.

The ice separated from the surface of the second tray 380 may drop downward and be stored in the ice bin 600.

In this embodiment, as shown in FIG. 15, the position at which the second tray 380 is pressed by the second pusher 540 and deformed may be referred to as an ice separation position.

Whether the ice bin 600 is full may be detected while the second tray 380 moves from the ice making position to the ice separation position.

For example, the full ice detection lever 520 rotates together with the second tray 380, and the rotation of the full ice detection lever 520 is interrupted by ice while the full ice detection lever 520 rotates. In this case, it may be determined that the ice bin 600 is in a full ice state. On the other hand, if the rotation of the full ice detection lever 520 is not interfered with the ice while the full ice detection lever 520 rotates, it may be determined that the ice bin 600 is not in the ice state.

After the ice is separated from the second tray 380, the controller 800 controls the driver 480 to allow the second tray 380 to move in the reverse direction (S10). Then, the second tray 380 moves from the ice separation position to the water supply position.

When the second tray 380 moves to the water supply position of FIG. 9, the controller 800 stops the driver 480 (S1).

When the second tray 380 is spaced apart from the extension part 544 while the second tray 380 moves in the reverse direction, the deformed second tray 380 may be restored to its original shape.

In the reverse movement of the second tray 380, the moving force of the second tray 380 is transmitted to the first pusher 260 by the pusher link 500, and thus, the first pusher 260 ascends, and the extension part 264 is removed from the ice making cell 320*a*.

In this embodiment, the cooling power of the cold air supply part 900 may be determined corresponding to a target temperature of the freezing compartment 32. The cold air generated by the cold air supply part 900 may be supplied to the freezing chamber 32.

The water of the ice making cell 320*a* may be phase-changed into ice by heat transfer between the cold water supplied to the freezing chamber 32 and the water of the ice making cell 320*a*.

In this embodiment, a heating amount of the transparent ice heater 430 for each unit height of water may be determined in consideration of predetermined cooling power of the cold air supply part 900.

A heating amount (or output) of the transparent ice heater 430 determined in consideration of the predetermined cooling power of the cold air supply part 900 is referred to as a reference heating amount (or reference output). The magnitude of the reference heating amount per unit height of water is different.

However, when the amount of heat transfer between the cold of the freezing compartment 32 and the water in the ice making cell 320*a* is variable, if the heating amount of the transparent ice heater 430 is not adjusted to reflect this, the transparency of ice for each unit height varies.

In this embodiment, the case in which the heat transfer amount between the cold and the water increase may be a case in which the cooling power of the cold air supply part 900 increases or a case in which the air having a temperature lower than the temperature of the cold air in the freezing compartment 32 is supplied to the freezing compartment 32.

On the other hand, a case in which the heat transfer amount of cold air and water is reduced may be, for example, a case in which the cooling power of the cold air supply pat 900 is reduced, a case in which the door is opened, and air having a temperature higher than the temperature of the cold air in the freezing compartment 32 is supplied to the freezing compartment 32, a case in which food having a temperature higher than the temperature of cold air in the freezing compartment 32 is put into the freezing compartment 32, or a case a defrost heater (not shown) for defrosting of the evaporator is turned on.

For example, a target temperature of the freezing compartment 32 is lowered, an operation mode of the freezing compartment 32 is changed from a normal mode to a rapid cooling mode, an output of at least one of the compressor or the fan increases, or an opening degree increases, the cooling power of the cold air supply part 900 may increase.

On the other hand, the target temperature of the freezer compartment 32 increases, the operation mode of the freezing compartment 32 is changed from the rapid cooling mode to the normal mode, the output of at least one of the compressor or the fan decreases, or the opening degree of the refrigerant valve decreases, the cooling power of the cold air supply part 900 may decrease.

When the heat transfer amount of cold air and water increases, the temperature of the cold air around the ice maker 200 decreases to increase in rate of ice generation.

On the other hand, if the cooling power of the cold air supply part 900 decreases, the temperature of the cold air around the ice maker 200 increases, the ice making rate decreases, and also, the ice making time increases.

Therefore, in this embodiment, when the amount of heat transfer of cold and water increases so that the ice making rate is maintained within a predetermined range lower than the ice making rate when the ice making is performed with the transparent ice heater 430 that is turned off, the heating amount of transparent ice heater 430 may be controlled to increase.

On the other hand, when the amount of heat transfer between the cold and the water decreases, the heating amount of transparent ice heater 430 may be controlled to decrease.

In this embodiment, when the ice making rate is maintained within the predetermined range, the ice making rate is less than the rate at which the bubbles move in the portion at which the ice is made, and no bubbles exist in the portion at which the ice is made.

The invention claimed is:

1. A refrigerator comprising:

a storage chamber; and an ice maker comprising:

a first tray having a first portion of a cell;

a first tray case configured to support the first tray;

a second tray having a second portion of the cell, the first portion and the second portion being configured to define a space formed by the cell in which a liquid is phase-changed into ice;

a temperature sensor configured to detect a temperature of the liquid or the ice in the space of the cell and mounted on the first tray case;

a heater configured to supply heat to the cell in an ice making process;

a controller configured to move the second tray by a driver motor from an ice making position to an ice separation position for an ice separation process to separate the ice from the cell after completion of the ice making process, wherein the temperature sensor is in contact with the first tray, wherein the first tray and the second tray define a first ice making cell and a second ice making cell, and wherein the temperature sensor is positioned so that a first distance between a cold air hole, through which cold air flows, and the temperature sensor is less than a second distance between the cold air hole and the first ice making cell, the second distance between the first ice making cell and the cold air hole is greater than a third distance between the second ice making cell and the cold air hole.

2. The refrigerator of claim 1, wherein the driver motor is configured to move the second tray.

3. The refrigerator of claim 1, wherein the first tray includes a sensor accommodation region in which the temperature sensor is accommodated.

4. The refrigerator of claim 3, wherein the sensor accommodation region is recessed toward the second tray.

5. The refrigerator of claim 1, wherein the first tray includes a communication hole, and wherein a distance from the temperature sensor to a contact region between the first tray and the second tray is less than a distance from the communication hole to the contact region between the first tray and the second tray.

6. The refrigerator of claim 1, wherein the first tray and the second tray define the first ice making cell and the second ice making cell, and at least a portion of the temperature sensor is positioned between the first ice making cell and the second ice making cell.

7. The refrigerator of claim 6, wherein the first ice making cell and the second ice making cell are arranged in a first direction, and the temperature sensor overlaps the first and second ice making cells in the first direction.

8. The refrigerator of claim 1, wherein the temperature sensor is positioned to be in contact with the first ice making cell.

9. The refrigerator of claim 1, wherein at least a portion of the temperature sensor is positioned between the first ice making cell and the second ice making cell.

10. The refrigerator of claim 9, wherein the first tray and the second tray define a third ice making cell, the second ice making cell is positioned between the first and third ice making cells, and a distance between a center of the first ice making cell and a center of the second ice making cell is greater than a distance between the second ice making cell and a center of the third ice making cell.

11. The refrigerator of claim 1, further comprising an additional heater configured to supply heat to at least one of the first tray or the second tray in the ice separation process.

12. The refrigerator of claim 11, wherein the additional heater is provided on the first tray and the temperature sensor is positioned to be spaced apart from the additional heater.

13. The refrigerator of claim 12, wherein a distance from the temperature sensor to a contact region between the first tray and the second tray is less than a distance from the additional heater to the contact region between the first tray and the second tray.

14. A refrigerator comprising:

a storage chamber;

a cooler configured to supply cold air into the storage chamber; and an ice maker comprising:

a liquid supply configured to supply a liquid;

a tray having a first portion and a second portion of a cell, the second portion being movable relative to the first portion, and the first portion and the second portion being configured to define a space formed by the cell in which the liquid is phase-changed to form ice;

a heater provided adjacent to the first portion; and a temperature sensor configured to detect a temperature of the liquid or the ice in the space of the cell, wherein the temperature sensor is in contact with the first portion and positioned to be spaced apart from the heater, and wherein a distance from the temperature sensor to a contact region between the first portion and the second portion is less than a distance from the heater to the contact region between the first portion and the second portion.

15. The refrigerator of claim 14, wherein the heater is turned on during an ice removal process when the ice is being removed from the space of the cell.

16. The refrigerator of claim 14, wherein the temperature sensor is received in a sensor accommodation region in the first portion.

17. The refrigerator of claim 14, wherein the cell defined by the tray includes a first ice making cell, and a second ice making cell, and at least a portion of the temperature sensor is positioned between the first ice making cell and the second ice making cell.

18. The refrigerator of claim 17, wherein the first ice making cell and the second ice making cell are arranged in a first direction, and the temperature sensor overlaps the first and second ice making cells in the first direction.

19. A refrigerator comprising:

a storage chamber;

a cooler configured to supply cold air into the storage chamber; and an ice maker comprising:

a liquid supply configured to supply a liquid;

a tray having a first portion and a second portion of a cell, the second portion being movable relative to the first portion, and the first portion and the second portion being configured to define a space formed by the cell in which the liquid is phase-changed to form ice;

a heater provided adjacent to at least one of the first portion or the second portion; and a temperature sensor configured to detect a temperature in the space of the cell, wherein at least one of the first portion or the second portion includes a sensor accommodation region in which the temperature sensor is accommodated, and wherein the sensor accommodation region is recessed toward another one of the first portion or the second portion.

* * * * *